US010658808B2

(12) United States Patent
Karrasch et al.

(10) Patent No.: US 10,658,808 B2
(45) Date of Patent: May 19, 2020

(54) TERMINAL CASSETTE ASSEMBLY

(71) Applicant: TE CONNECTIVITY CORPORATION, Berwyn, PA (US)

(72) Inventors: Christopher John Karrasch, Carlisle, PA (US); Michael Morris, Harrisburg, PA (US)

(73) Assignee: TE Connectivity Corporation, Berwyn, PA (US)

( * ) Notice: Subject to any disclaimer, the term of this patent is extended or adjusted under 35 U.S.C. 154(b) by 245 days.

(21) Appl. No.: 15/638,483

(22) Filed: Jun. 30, 2017

(65) Prior Publication Data

US 2019/0006808 A1 Jan. 3, 2019

(51) Int. Cl.

| | |
|---|---|
| ***H01R 43/048*** | (2006.01) |
| ***H01R 43/055*** | (2006.01) |
| ***H01R 43/052*** | (2006.01) |
| ***H01R 43/20*** | (2006.01) |

(52) U.S. Cl.

CPC ..... *H01R 43/0482* (2013.01); *H01R 43/052* (2013.01); *H01R 43/055* (2013.01); *H01R 43/20* (2013.01); *Y10T 29/53235* (2015.01)

(58) Field of Classification Search

CPC ..... H01R 43/0482; H01R 43/052; H01R 43/055; H01R 43/20; Y10T 29/53235

See application file for complete search history.

(56) References Cited

U.S. PATENT DOCUMENTS

| | | | | |
|---|---|---|---|---|
| 4,784,262 | A * | 11/1988 | Duddy | H01R 43/045 206/413 |
| 5,661,897 | A | 9/1997 | Kaneda et al. | |
| 5,794,333 | A * | 8/1998 | Shea | H01R 43/055 29/753 |
| 6,694,795 | B1 * | 2/2004 | Quinn | H01R 43/055 29/753 |
| 7,024,752 | B2 * | 4/2006 | Imgrut | H01R 43/0486 29/448 |
| 7,340,812 | B2 | 3/2008 | Speck | |
| 8,176,626 | B2 | 5/2012 | Kirst | |
| 2014/0150260 | A1 | 6/2014 | Fischer | |
| 2019/0006808 | A1 * | 1/2019 | Karrasch | H01R 43/0482 |

FOREIGN PATENT DOCUMENTS

| | | | |
|---|---|---|---|
| DE | 202011107870 | U1 | 2/2013 |
| WO | 2006136930 | A1 | 12/2006 |

OTHER PUBLICATIONS

European Search Report, European Application No. EP18180387-5-1201, European Filing Date, dated Oct. 19, 2018.

(Continued)

*Primary Examiner* — Minh N Trinh

(57) ABSTRACT

A terminal cassette assembly for a terminal crimping machine includes a cassette housing having a terminal reel chamber holding a terminal reel and a crimp tooling chamber holding crimp tooling with a terminal reel door and a crimp tooling cover, respectively. The crimp tooling includes lower tooling including an anvil and upper tooling including a wire crimper. At least one of the upper tooling and the lower tooling are held in position relative to the terminal crimping machine by the cassette housing when the cassette housing is coupled to the terminal crimping machine.

21 Claims, 6 Drawing Sheets

(56) References Cited

OTHER PUBLICATIONS

Artos Engineering Company, CR.11 Automatic Crimping Machine Data Sheet.
Schaefer Werkzeug-und Sondermaschinebau GmBH, Applicator Shuttle System Data Sheet, Version 20170509.
Schleuniger Group, ToolingShuttle 30 Data Sheet and ToolingShuttle 61 Data Sheet.

* cited by examiner

TERMINAL CASSETTE ASSEMBLY

BACKGROUND OF THE INVENTION

The subject matter herein relates generally to a terminal cassette for use with terminal crimping machines for crimping electrical terminals to a wire.

Terminal crimping machines have long been used in the connector industry to effect high-speed mass termination of various cables. It is common practice for the terminal crimping machine to have an interchangeable tooling assembly called an applicator. In general, such terminal crimping machines are referred to as a terminator or press; however other types of terminal crimping machines may similarly be used, such as a lead maker or a bench machine. The applicator is typically mounted to a frame of the terminator. The applicator includes an applicator ram, which is operably coupled to a terminator ram of the terminator. The applicator holds crimp tooling, such as an anvil and a wire crimper, which is attached to the movable applicator ram. During crimping, the terminator ram moves the applicator ram, which moves the wire crimper relative to the anvil during a crimping stroke to crimp a terminal or connector to an end of a wire.

However, these known terminal crimping machines are not without disadvantages. For instance, loading of the terminals into the crimping zone of the application is challenging. For example, the terminals are typically stored on a reel that is separately coupled to the applicator or terminator frame. The terminals may be damaged when setting up the reel on the applicator or terminator frame. The setup time is lengthy. For example, the applicator and the reel are stored separately, transported separately and loaded separately into the terminal crimping machine. Additionally, because the reel of terminals is stored separately from the applicator, it is possible to install the incorrect applicator or incorrect reel into the terminal crimping machine, which may cause damage to the terminals and/or the crimp tooling. Some known systems provide a cart for storing and transporting the reels and the applicators together, however, the terminals and the applicators are exposed and may be damaged during storage, transportation or use. Such carts tend to be bulky and require a large space for storage of many carts.

A need remains for a system that locates the terminal reel relative to the crimp tooling and allows for easy set-up, transportation and storage while protecting the tooling and terminals.

BRIEF DESCRIPTION OF THE INVENTION

In one embodiment, a terminal cassette assembly is provided for a terminal crimping machine that includes a cassette housing having a terminal reel chamber and a crimp tooling chamber. The cassette housing has a terminal reel door covering the terminal reel chamber and a crimp tooling cover covering the crimp tooling chamber. The cassette housing is configured to be removably coupled to the terminal crimping machine. The terminal cassette assembly includes a terminal reel received in the terminal reel chamber enclosed by the cassette housing and the terminal reel door. The terminal reel door provides access to the terminal reel. The terminal reel has a strip of terminals configured to be crimped to corresponding wires by the terminal crimping machine. The terminal cassette assembly includes crimp tooling received in the crimp tooling chamber enclosed by the cassette housing and the crimp tooling cover. The crimp tooling cover provides access to the crimp tooling. The crimp tooling includes lower tooling including an anvil for supporting the terminal and the wire during crimping and upper tooling including a wire crimper for forming the terminal around the wire during crimping. The cassette housing locates at least one of the upper tooling and the lower tooling in position relative to the terminal crimping machine when the cassette housing is coupled to the terminal crimping machine. At least one of the upper tooling and the lower tooling are held in position relative to the terminal crimping machine by the cassette housing when the cassette housing is coupled to the terminal crimping machine.

In another embodiment, a terminal cassette assembly is provided for a terminal crimping machine including a cassette housing having a terminal reel chamber holding a terminal reel including a strip of terminals configured to be crimped to corresponding wires by the terminal crimping machine. The cassette housing has a mounting platform configured to be removably coupled to the terminal crimping machine to locate the cassette housing relative to the terminal crimping machine. Crimp tooling is supported on the mounting platform that includes lower tooling including an anvil for supporting the terminal and the wire during crimping and upper tooling including a wire crimper for forming the terminal around the wire during crimping. A terminal guide is supported on the mounting platform. The terminal guide is positioned adjacent at least one of the lower tooling and the upper tooling. The strip of terminals is routed to the terminal guide and guided by the terminal guide as the strip of terminals are advanced during crimping by the terminal crimping machine. A crimp tooling cover is coupled to the cassette housing that encloses the crimp tooling and the terminal guide when closed. The cassette housing locates the crimp tooling and the terminal guide in position relative to the terminal crimping machine when the cassette housing is coupled to the terminal crimping machine. The mounting platform holds the terminal guide and at least one of the lower tooling and the upper tooling in position relative to the terminal crimping machine when the cassette housing is coupled to the terminal crimping machine and the terminal crimping machine is operated. The crimp tooling cover is opened to expose the crimp tooling and the terminal guide when the cassette housing is coupled to the terminal crimping machine to allow the upper tooling to be operably coupled to the terminal crimping machine during crimping.

DETAILED DESCRIPTION OF THE INVENTION

Figure 1:
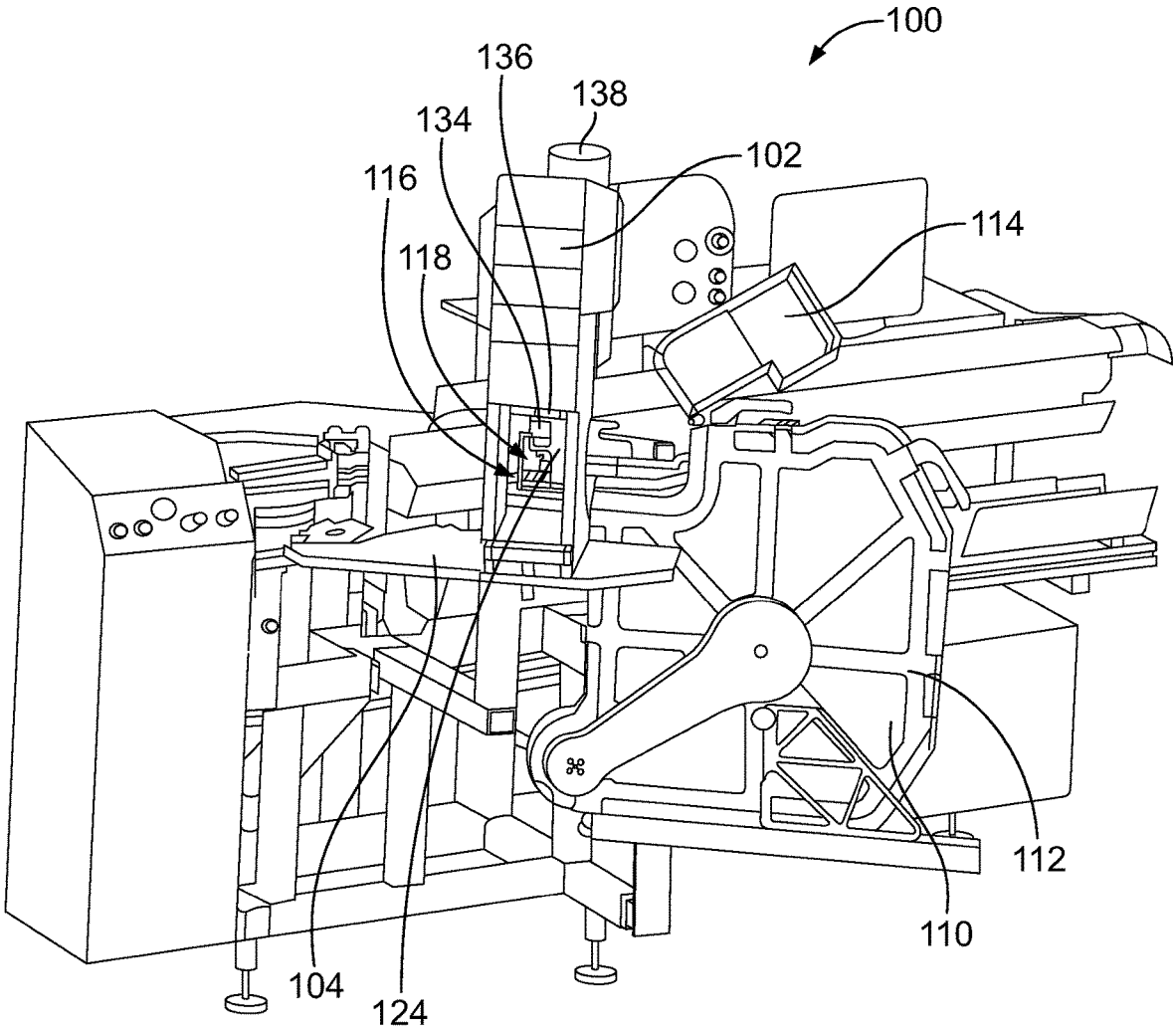
FIG. 1 illustrates a terminal crimping machine in accordance with an exemplary embodiment showing a cassette assembly in a loaded position.

FIG. 1 illustrates a terminal crimping machine 100 in accordance with an exemplary embodiment for crimping connectors or terminals to wires. In the illustrated embodiment, the terminal crimping machine 100 is a lead maker; however, other types of terminal crimping machines may similarly be used, such as a bench machine, a terminator, a press and the like. In the illustrated embodiment, the terminal crimping machine 100 includes one or more termination tools 102 that are used for crimping terminals to wires.

In an exemplary embodiment, the terminal crimping machine 100 includes a frame 104 supporting various components, such as the termination tool 102. The frame 104 may include support rails, support plates, beams, cross-beams, panels, and the like. The terminal crimping machine 100 may include a wire feeder for feeding wires to the termination tool 102. The terminal crimping machine 100 may include a controller for controlling operation of the terminal crimping machine 100, such as the wire feeder and the termination tool 102.

In an exemplary embodiment, the terminal crimping machine 100 is used with one or more terminal crimp tooling cassette assemblies 110 (also referred to hereinafter as simply terminal cassette assemblies or cassettes) for supplying terminals and tooling to the terminal crimping machine 100. Each cassette assembly 110 has a spool of terminals. The terminal crimp tooling cassette assembly 110 may also include crimp tooling 116 for crimping the terminals to the wires. The cassette assembly 110 keeps the crimp tooling 116 with the terminal reel and is removably coupled to the frame 104 of the terminal crimping machine 100. The cassette assembly 110 allows the crimp tooling 116 to be stored, transported and loaded into the terminal crimping machine 100 with the terminal reel, which may prevent damage to the terminals and/or may simplify and speed up the assembly or set-up time for each crimping run. The cassette assemblies 110 may be removably coupled to the frame 104, such as to remove the cassette assembly 110 and replace with a new cassette assembly 110, such as when the terminal spool is empty or when terminating a different type or size of terminal. In various embodiments, the cassette assembly 110 is removably coupled to the corresponding termination tool 102 and feeds the terminals to the termination tool 102. The cassette assemblies 110 enclose the terminal reel and the crimp tooling to protect the terminals and the crimp tooling, such as during storage and transport.

FIG. 1 illustrates the cassette assembly 110 in a loaded position in the terminal crimping machine 100. The cassette assembly 110 may be wheeled or otherwise transported into position relative to the terminal crimping machine 100.

Figure 2:
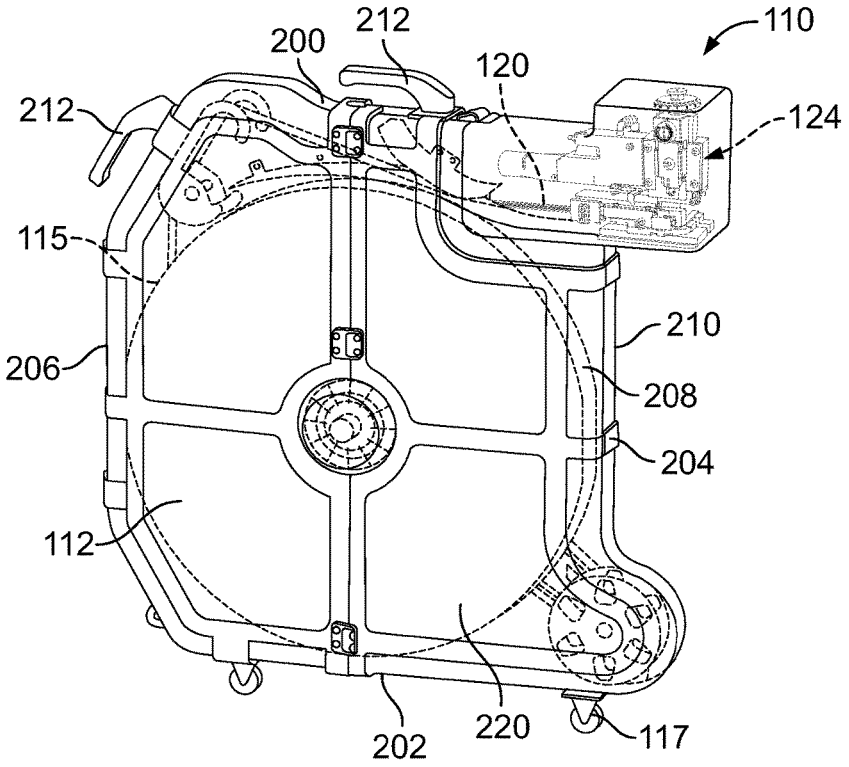
FIG. 2 is a perspective view of the cassette assembly in accordance with an exemplary embodiment in a closed position.

The cassette assembly 110 includes a cassette housing 112 for holding the terminals on a terminal reel 115 (FIG. 2). The cassette housing 112 may be supported by and movable by wheels on the bottom of the cassette housing 112. The cassette assembly 110 includes a crimp tooling cover 114 coupled to the cassette housing 112. The crimp tooling cover 114 may be pivotably coupled to the cassette housing 112 at a hinge. In an exemplary embodiment, the cassette assembly 110 holds crimp tooling 116 used for crimping the terminals associated with the cassette assembly 110. The crimp tooling 116 is matched to the particular terminals of the terminal reel 115 and held in the cassette housing 112. The crimp tooling 116 is movable with the cassette housing 112 and is configured to be coupled to and removed from the termination tool 102 with the cassette assembly 110. The cassette assembly 110 is configured to be coupled to the machine 100 such that the crimp tooling 116 may be removably coupled to the termination tool 102 at a crimping zone 118 of the termination tool 102. Removal of the cassette assembly 110 may remove the crimp tooling 116 from the termination tool 102. However, in some embodiments or situations, a portion of the crimp tooling 116, such as the applicator and/or the upper tooling, may remain in the termination tool 102, such as when replacing a terminal spool, to prevent having to re-install and re-align to the terminal tool 102. The cassette housing 112 and the crimp tooling cover 114 enclose the terminals and the crimp tooling 116 to protect the terminals and the crimp tooling 116 during storage, transport and use.

Figure 8:
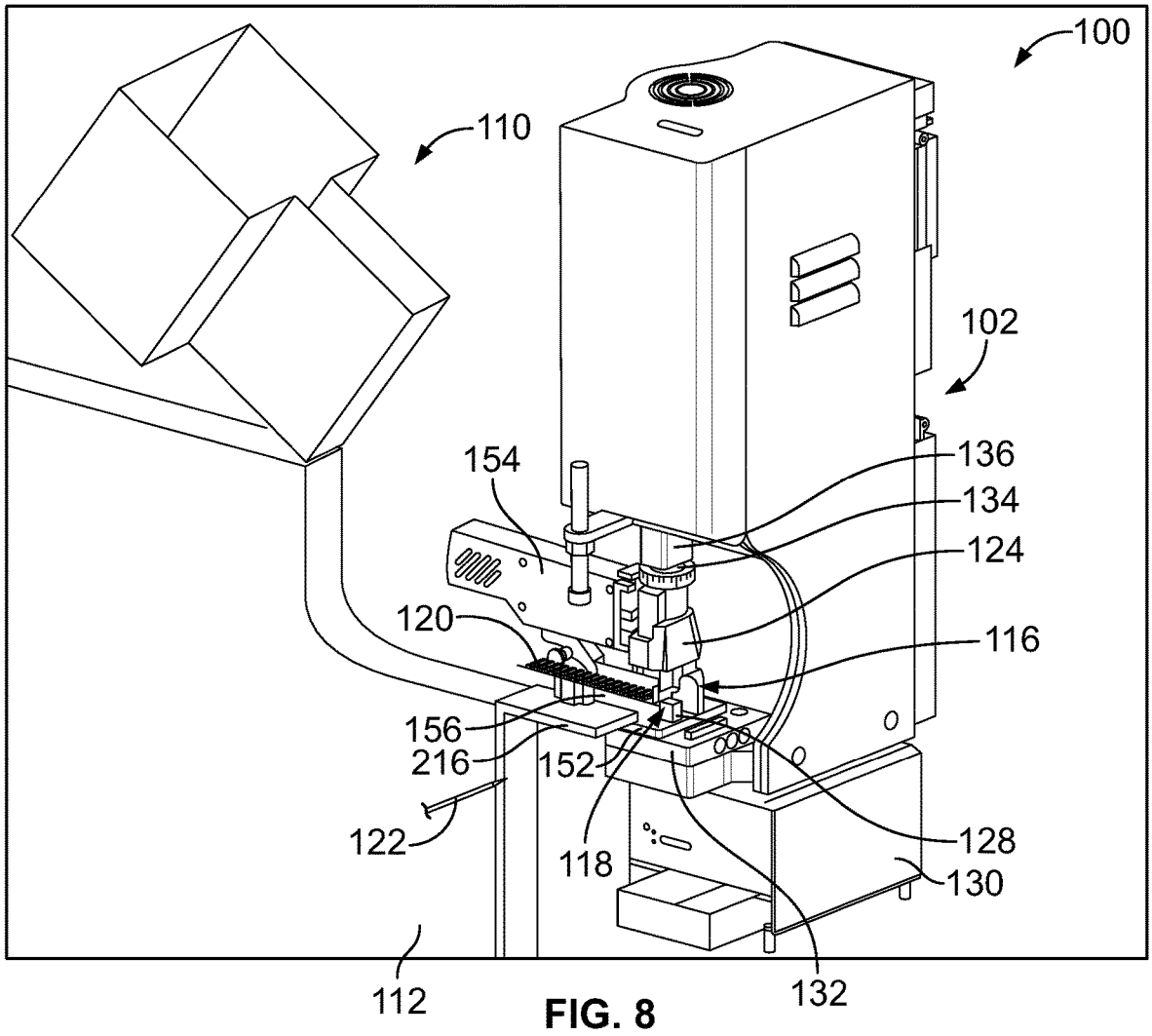
FIG. 8 is a perspective view of a portion of a terminal crimping machine showing the cassette assembly in accordance with an exemplary embodiment coupled to a termination tool

The termination tool 102 is used to terminate terminals 120 (shown in FIG. 8) to wires 122 (shown in FIG. 8). The termination tool 102 uses the crimp tooling 116 to crimp the terminal 120 to the wire 122. In an exemplary embodiment, the crimp tooling 116 may be defined as an applicator 124. The applicator 124 is configured to be received in the termination tool 102 and is configured to be operably coupled to the termination tool 102 for moving the crimp tooling 116 during the crimping operation. In alternative embodiments, the crimp tooling 116 may be directly coupled to and operated by the termination tool 102 rather than using the applicator 124. In an exemplary embodiment, the crimp tooling 116 includes upper tooling 126 and lower tooling 128. The terminal 120 and the wire 122 are crimped between the upper tooling 126 and the lower tooling 128. As noted above, in an exemplary embodiment, the crimp tooling 116 is removably coupled within the termination tool 102 using the applicator 124 (for example, coupled to the applicator ram), which supports and operates the upper tooling 126 and the lower tooling 128. However, the upper tooling 126 and the lower tooling 128 may be removably coupled to the termination tool 102 without the applicator 124 in various other embodiments, such as by directly connecting to the termination tool 102 (for example, to the terminator ram).

When the cassette assembly 110 is coupled to the terminal crimping machine 100, the applicator 124 may be coupled to and supported by the terminator 102. In other various embodiments, the upper tooling 126 and/or lower tooling 128 may be directly coupled to and supported by the terminator 102. In an exemplary embodiment, the upper tooling 126 and/or lower tooling 128 may be removable from the cassette assembly 110 so that the cassette assembly 110 having a new reel may be attached to the terminal crimping machine 100.

In an exemplary embodiment, the applicator 124 includes an applicator ram 134 that is movable up and down during the crimping operation. For example, the applicator ram 134 may be coupled to a terminator ram 136 of the termination tool 102. The applicator ram 134 is driven by the terminator ram 136. The upper tooling 126 is operably coupled to and driven by the applicator ram 134 through the crimp stroke. During operation, the terminator ram 136 is actuated or driven through a crimp stroke by a driving mechanism or actuator 138 of the terminal crimping machine 100. For example, the actuator 138 may be a motor having a crank shaft that moves the terminator ram 136. Alternatively, the actuator 138 may be a linear actuator, a piezoelectric actuator, a pneumatic actuator, and the like. The terminator ram 136 is directly driven by the actuator 138, which drives the applicator ram 134 and thus the crimp tooling 116. In other various embodiments, the upper tooling 126 may be removably coupled directly to the terminator ram 136, such as in embodiments that do not utilize the applicator 124.

Figure 6:
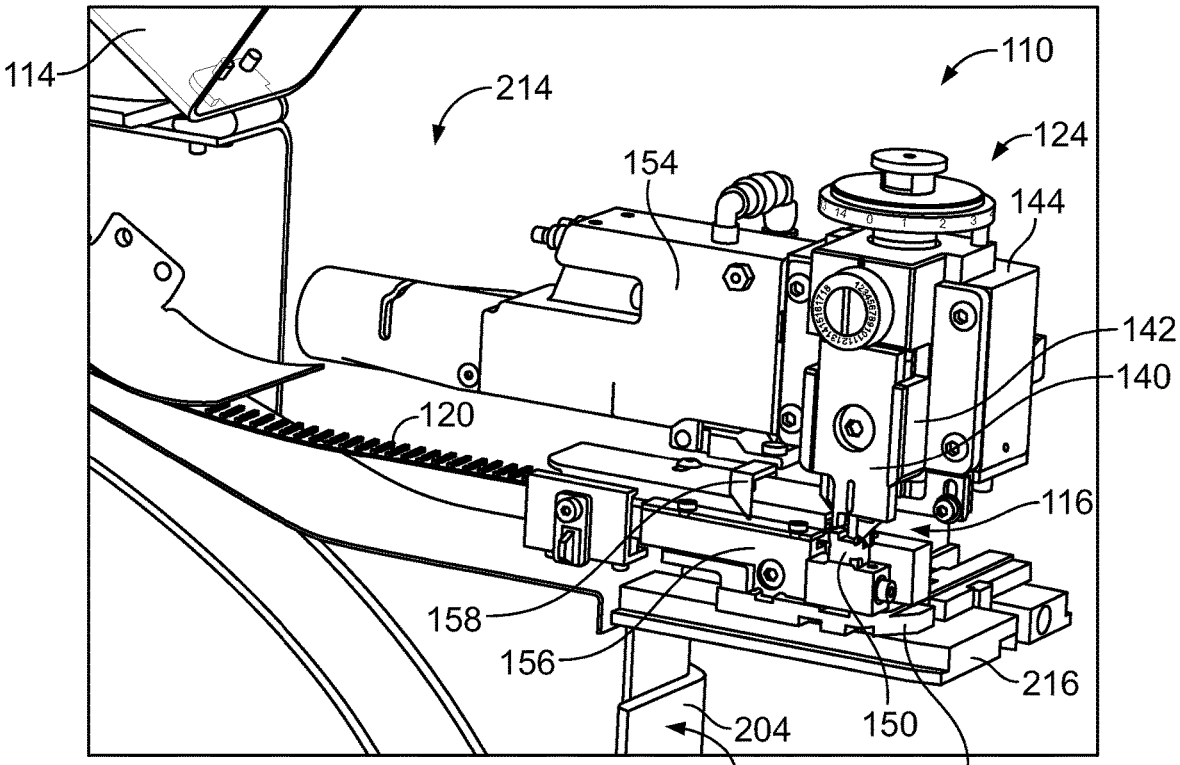
FIG. 6 is an enlarged perspective view of a portion of the cassette assembly in accordance with an exemplary embodiment.

With reference to FIG. 6, in an exemplary embodiment, the upper tooling 126 includes a wire crimper 140 and a wire crimper holder 142. The wire crimper 140 is configured to crimp the terminal 120 to the wire 122 during crimping. The wire crimper holder 142 is configured to be coupled to the applicator ram 134, such as to an applicator frame 144, or directly to the terminator ram 136. In an exemplary embodiment, the lower tooling 128 includes an anvil 150 supported by a base 152. The anvil 150 is used to support the terminal 120 during crimping. The anvil 150 may be part of or supported by the applicator frame 144 or may be supported by the termination tool 102.

In an exemplary embodiment, a terminal feeder 154 is used to feed the terminals 120 to the crimping zone 118. The terminal feeder 154 may be part of the applicator 124 or may be part of the termination tool 102. The terminal feed system may include a terminal guide 156 for guiding the terminals 120 to the crimp zone and a feed finger 158 actuated by the terminal feeder 154 to advance the terminal 120 to the crimp zone. The terminal feeder 154 may be coupled to the applicator 124, such as to the applicator frame 144. As such, the terminal feeder 154 may be part of the cassette assembly 110 and is removable with the cassette assembly 110. The terminal feeder 154 is transported, stored and loaded into the termination tool 102 with the cassette assembly 110. In alternative embodiments, the terminal feeder 154 may be attached to the terminator tool 102. In an exemplary embodiment, the terminal guide 156 may be part of the lower tooling 128 and supported by the base 152 and removable from the termination tool 102 with the base 152 rather than being part of the applicator 124. The housing 112 and/or the crimp tooling cover 114 enclose the terminal guide 156 and/or the terminal feeder 154 to protect during storage, transport and use.

During crimping, the terminator ram 136 is driven by the actuator 138 to drive the applicator ram 134. The wire crimper 140 of the upper tooling 126, which is coupled to the applicator ram 134, is driven with the terminator ram 136. The anvil 150 supports the terminal 120 and the wire 122 during the crimping process and the wire crimper 140 forms the terminal 120 around the wire 122 to mechanically and electrically connect the terminal 120 to the wire 122 during the crimping process. The wire crimper 140 is movable in an advancing direction and a retracting direction relative to the anvil 150 during the crimp stroke. The wire crimper 140 is cyclically driven through the crimp stroke from a rest position at a top of the crimp stroke to the crimping position, such as through a bottom dead center position at a bottom of the crimp stroke, then returning to the rest position. The crimp stroke has both an advancing or downward component and a return or upward component. Optionally, the wire crimper 140 may include both a conductor crimper for crimping the terminal 120 to the conductor of the wire 122 and an insulation crimper for crimping the terminal 120 to the insulation, such as the jacket, of the wire 122. In embodiments that do not utilize the applicator 124, the upper tooling 126 is driven by another component, such as directly by the terminator ram 136.

Figure 3:
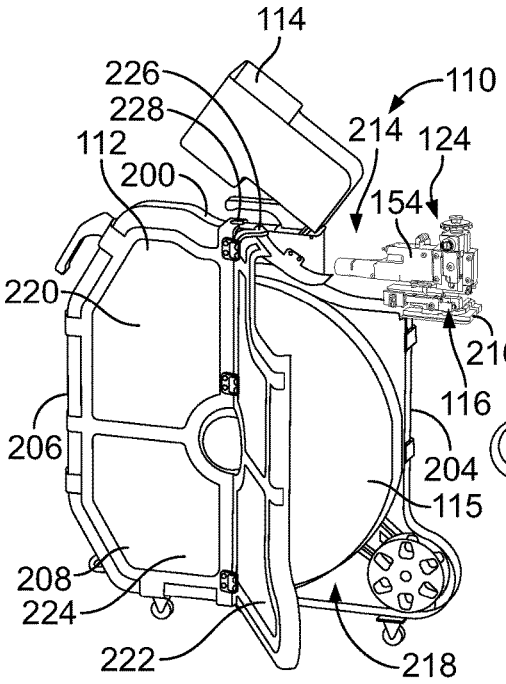
FIG. 3 is a perspective view of the cassette assembly in accordance with an exemplary embodiment in a partially opened position.
Figure 4:
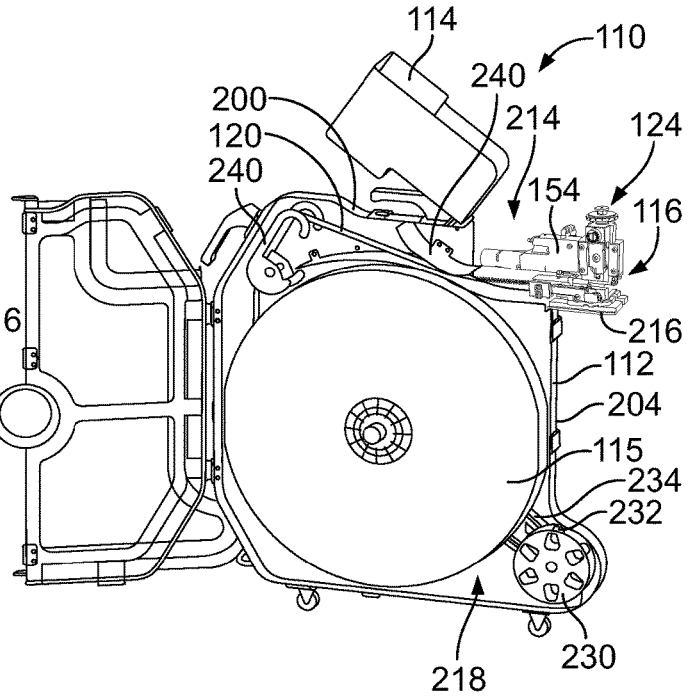
FIG. 4 is a perspective view of the cassette assembly in accordance with an exemplary embodiment in an opened position.
Figure 5:
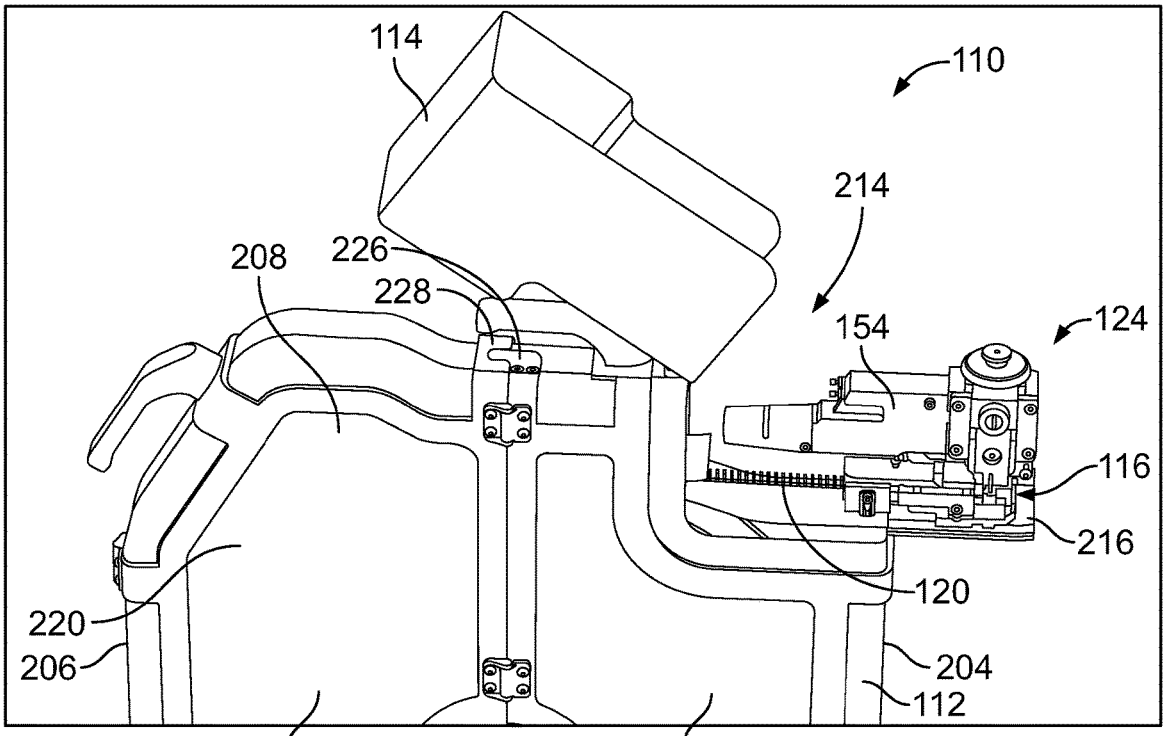
FIG. 5 is an enlarged perspective view of a portion of the cassette assembly in accordance with an exemplary embodiment.
Figure 7:
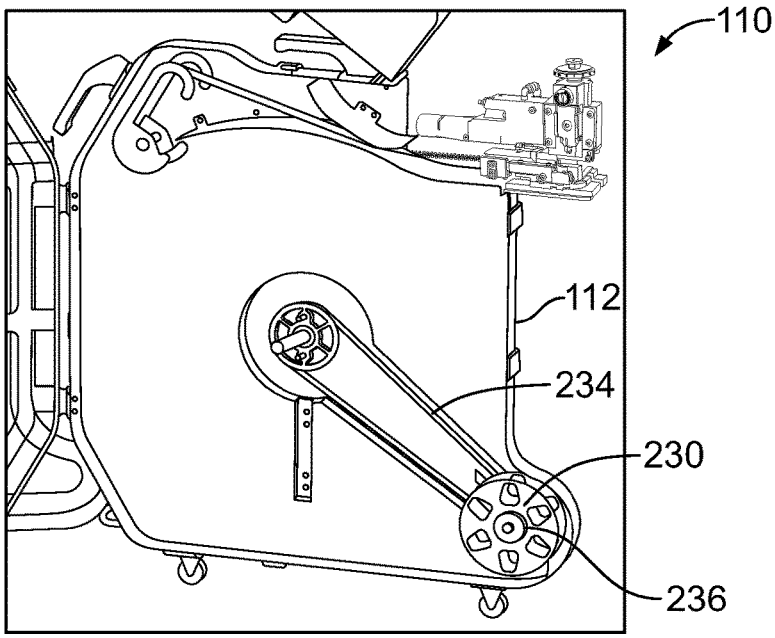
FIG. 7 is an enlarged perspective view of a portion of the cassette assembly in accordance with an exemplary embodiment.

FIG. 2 is a perspective view of the cassette assembly 110 in accordance with an exemplary embodiment in a closed position. FIG. 3 is a perspective view of the cassette assembly 110 in accordance with an exemplary embodiment in a partially opened position. FIG. 4 is a perspective view of the cassette assembly 110 in accordance with an exemplary embodiment in an opened position. FIG. 5 is an enlarged perspective view of a portion of the cassette assembly 110 in accordance with an exemplary embodiment. FIG. 6 is an enlarged perspective view of a portion of the cassette assembly 110 in accordance with an exemplary embodiment. FIG. 7 is an enlarged perspective view of a portion of the cassette assembly 110 in accordance with an exemplary embodiment.

The cassette assembly 110 includes the cassette housing 112 that holds the terminal reel 115 of terminals 120 and the crimp tooling 116, such as with the applicator 124. The cassette housing 112 includes a top 200, a bottom 202, a front 204, a rear 206, a first side 208 and a second side 210 giving the cassette housing 112 a generally box-shaped profile; however, the cassette housing 112 may have other shapes in alternative embodiments. With reference to FIG. 2, the wheels 117 are provided at the bottom 202. In an exemplary embodiment, one or more handles 212 are provided, such as at or near the top 200 for moving, lifting, transporting or otherwise manipulating the cassette assembly 110, such as into or out of the terminal crimping machine 100 (shown in FIG. 1).

With reference to FIGS. 3-6, in the illustrated embodiment, the applicator 124 holding the crimp tooling 116 is provided proximate to the top 200 and the front 204 for loading into the terminal crimping machine 100 (FIG. 1). The crimp tooling cover 114 is coupled to the cassette housing 112 at the top 200 proximate to the front 204 for covering the applicator 124, including the crimp tooling 116, the terminal guide 156 and/or the terminal feeder 154. The crimp tooling cover 114 may be opened or closed, such as by pivoting the crimp tooling cover 114 about a hinge attached to the cassette housing 112. The crimp tooling cover 114 covers a crimp tooling chamber 214 of the cassette housing 112. The crimp tooling 116 is located in the crimp tooling chamber 214. For example, the applicator 124 supporting the crimp tooling 116 attached to the base 152 is mounted to a mounting platform 216 attached to or integral with the cassette housing 112. The cassette housing 112 and the crimp tooling cover 114 may be closed around the crimp tooling 116 to close off the crimp tooling chamber 214, such as to protect the crimp tooling 116 during transportation and storage.

With reference to FIGS. 5-6, in an exemplary embodiment, the mounting platform 216 extends forward of the front 204 of the cassette housing 112. In an exemplary embodiment, the mounting platform 216 is generally fixed relative to the cassette housing 112. As such, the mounting platform 216 holds the applicator 124 and the crimp tooling 116 in a generally fixed position relative to the cassette housing 112. Optionally, the mounting platform 216 may move slightly relative to the cassette housing 112, such as front to back and/or side to side and/or up and down to locate the applicator 124 relative to the cassette housing 112.

However, the applicator 124 may remain attached to the mounting platform 216 when the cassette assembly 110 is mounted to the terminal crimping machine 100 and the terminal crimping machine 100 is operated to crimp the terminals 120 to the wires 122.

With reference to FIGS. 3-4, in an exemplary embodiment, the walls or panels forming the cassette housing 112 define a terminal reel chamber 218 that receives the terminal reel 115. The terminal reel 115 may be removably coupled to the cassette housing 112 in the terminal reel chamber 218.

With reference to FIGS. 3 and 5, in an exemplary embodiment, a terminal reel door 220 is provided at the first side 208 to open and close the terminal reel chamber 218. For example, the terminal reel door 220 may be hingedly coupled to the cassette housing 112 at the rear 206 or elsewhere. In an exemplary embodiment, the terminal reel door 220 is a multi-panel door having a front panel 222 and a rear panel 224 hingedly coupled together. The multi-panel door design allows opening of the terminal reel door 220 in a smaller space. In an exemplary embodiment, the terminal reel door 220 includes a latching mechanism 226 that engages the latching mechanism 228 of the cassette housing 112 to secure the terminal reel door 220 to the cassette housing 112. For example, the latching mechanism 226 is received in the latching mechanism 228 to hold the front and rear panels 222, 224 closed. In the illustrated embodiment, the latching mechanism 226 is provided generally at the interface between the front and the rear panels 222, 224. Other types of doors may be provided in alternative embodiments. Optionally, rather than being hingedly coupled to the cassette housing 112, the terminal reel door 220 may be entirely removed from the cassette housing 112 to allow removal and replacement of the terminal reel 115. In other various embodiments, the terminal reel door 220 may be formed by a portion of the cassette housing 112, such as the approximately half of the cassette housing 112, such as the right half, the left half, the top half, the bottom half, and the like where the door includes a pocket that receives a portion of the terminal reel 115. When the terminal reel door 220 is closed, the terminal reel chamber 218 is entirely closed to protect the terminal reel 115 and other components during transportation and storage. In other various embodiments, the terminal reel door 220 and/or the cassette housing 112 may only partially cover the terminal reel 115 rather than enclosing the terminal reel 115.

With reference to FIGS. 4 and 7, in an exemplary embodiment, the cassette assembly 110 includes a paper take-up reel 230 winding a paper strip 232 from the strip of terminals 120 on the terminal reel 115. A link 234 is operably coupled between the terminal reel 115 and the paper take-up reel 230. As the paper take-up reel 230 is rotated, the link 234 helps to rotate the terminal reel 115 to remove tension on the strip of terminals. The link 234 may be a drive belt connected between the axles supporting the paper take-up reel 230 and the terminal reel 115. Other types of links 234 may be provided in alternative embodiments. In an exemplary embodiment, a driver 236 is provided for driving the paper take-up reel 230 or the terminal reel 115. For example, the driver 236 may be a motor or other type of driver directly connected to the terminal reel 115 or the paper take-up reel 230 to cause direct rotation of the terminal reel 115 or the paper take-up reel 203. The driver 236 may be operable in both forward and reverse directions to control the direction of rotation, such as to take up slack.

With reference to FIG. 4, in an exemplary embodiment, the cassette assembly 110 includes terminal guides 240 for guiding the strip of terminals between the terminal reel 115 and the terminal guide 156. The terminal guides 240 may support the strip of terminals from above, from below, and/or from either or both sides of the strip of terminals. The strip of terminals may slide along the terminal guides 240 as the terminals are fed by the terminal guide 156. The terminal guides 240 may be flexible to maintain tension on the strip of terminals as the strip of terminals are pulled through the cassette assembly 110. For example, the terminal guides 240 may flex downward as the terminals are advanced by the terminal guide 156 and as the terminal reel 115 lags or is not rotated quickly enough. Optionally, the terminal guides 240 may include a trigger or sensor operably coupled to the driver 236. For example, when the terminal feeder 240 is flexed beyond a trigger point indicating tension in the terminal strip, the trigger may cause the driver 236 to operate to cause the terminal reel 115 to rotate to relieve the tension in the terminal strip.

FIG. 8 is a perspective view of a portion of the terminal crimping machine 100 showing the cassette assembly 110 coupled to the termination tool 102 in accordance with an exemplary embodiment. When the cassette assembly 110 is loaded into the terminal crimping machine 100, the crimp tooling 116 is generally positioned in the crimping zone 118. For example, the cassette assembly 110 presents the applicator 124, holding the crimp tooling 116, to the termination tool 102.

The mounting platform 216 supports the applicator 124 and is loaded into the termination tool 102. The mounting platform 216 may be fixed to the terminator frame 130, such as to the base 132 to position the applicator 124 in the crimping zone 118. The applicator ram 134 may be coupled to the terminator ram 136 when the cassette assembly 110 is coupled to the terminal crimping machine 100. As such, the applicator 124 does not need to be removed from the cassette assembly 110, but rather remains mounted to the cassette housing 112 when the cassette housing 112 is loaded into the terminal crimping machine 100. The cassette assembly 110 is located relative to the termination tool 102 and thus properly positions the applicator 124 and the crimp tooling 116 in position relative to the terminal crimping machine 100 when the cassette housing 112 is coupled to the terminal crimping machine 100. The cassette housing 112, such as the mounting platform 216, holds the position of the applicator 124, and thus the crimp tooling 116, relative to the terminal crimping machine 100 when the cassette housing 112 is coupled to the terminal crimping machine 100. The applicator 124, and the base 152 of the lower tooling 128, is configured to be removably coupled to and securely fixed by the terminal crimping machine 100 without decoupling the applicator 124, and thus the base 152, from the cassette housing 112. The mounting platform 216 may support and hold the position of the terminal feeder 154 relative to the terminal crimping machine 100 when the cassette housing 112 is coupled to the terminal crimping machine 100 and the terminal crimping machine 100 is operated. Alternatively, the terminal feeder 154 may be part of the termination tool 102 and the application 124 and crimp tooling 116 may be positioned in the termination tool 102 relative to the terminal feeder 154.

Figure 9:
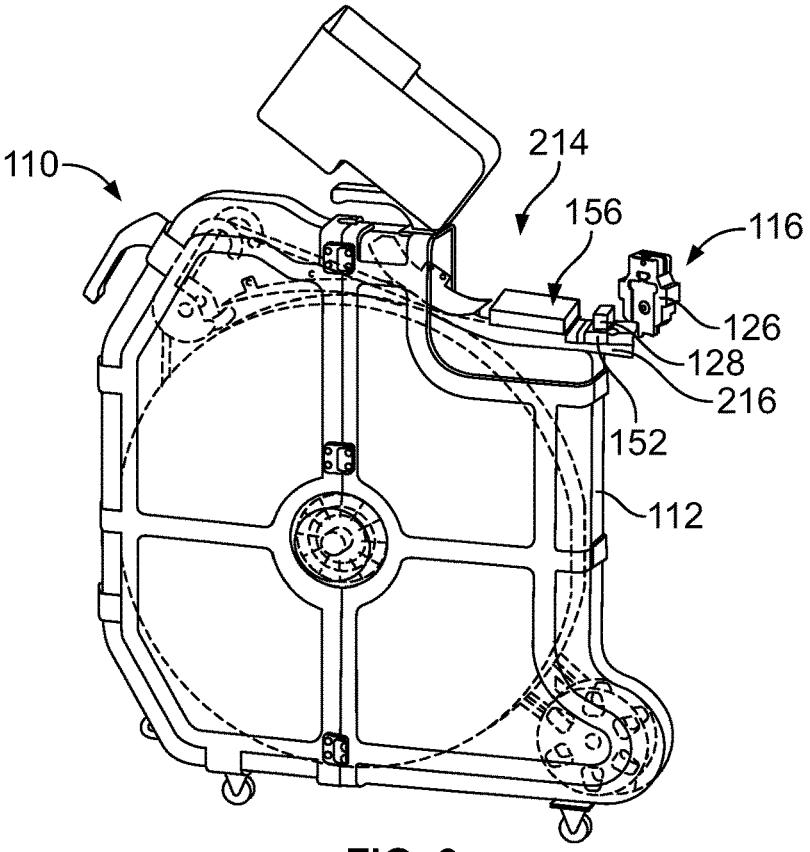
FIG. 9 is a front perspective view of the cassette assembly in accordance with an exemplary embodiment.
Figure 10:
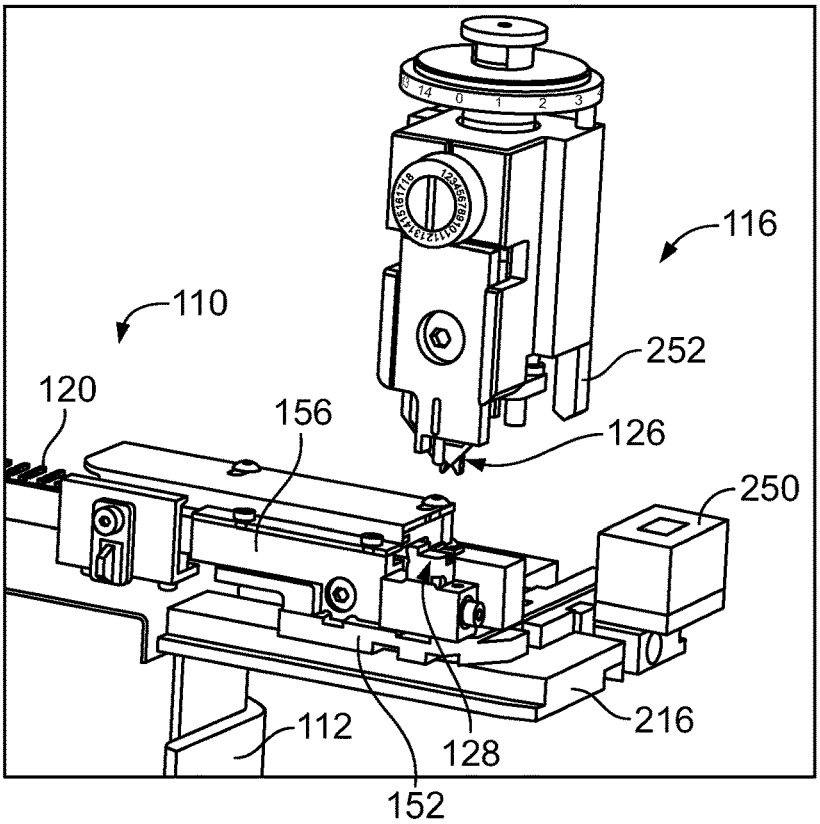
FIG. 10 is an enlarged view of a portion of the cassette assembly in accordance with an exemplary embodiment.

FIG. 9 is a front perspective view of the cassette assembly 110 in accordance with an exemplary embodiment. FIG. 10 is an enlarged view of a portion of the cassette assembly 110 in accordance with an exemplary embodiment. In the illustrated embodiment, the cassette assembly 110 is provided so that the cassette housing 112 supports the crimp tooling 116 without a separate applicator frame or applicator ram. For example, the crimp tooling 116 is supported by the mounting platform 216. As shown in FIG. 10, the lower tooling 128 is mounted to the mounting platform 216. For example, the base 152 is directly attached to the mounting platform 216. The terminal guide 156 is attached to the base 152 and is thus supported by the mounting platform 216.

In an exemplary embodiment, the upper tooling 126 is separate from the lower tooling 128. The upper tooling 126 may be positioned relative to the lower tooling 128 for crimping, but otherwise is independent from the lower tooling 128. During storage and transportation, in an exemplary embodiment, the upper tooling 126 is stored with the lower tooling 128. For example, as shown in FIG. 10, the upper tooling 126 may be mounted to the lower tooling 128 and supported by the lower tooling 128 in the crimp tooling chamber 214. For example, the lower tooling 128 may include a support 250 and the upper tooling 126 may include a support 252 coupled to the support 250 when the upper tooling 126 is stored with the lower tooling 128 (FIG. 10). The upper tooling 126 may be removed from the support 250 and coupled to the termination tool 102 (shown in FIG. 1) when the cassette assembly 110 is coupled to the terminal crimping machine 100. For example, the upper tooling 126 may be directly coupled to the terminator ram 136 (shown in FIG. 1). The crimp tooling 116 may be used to crimp the terminals 120 to the wires 122 without the need for the applicator 124.

Figure 11:
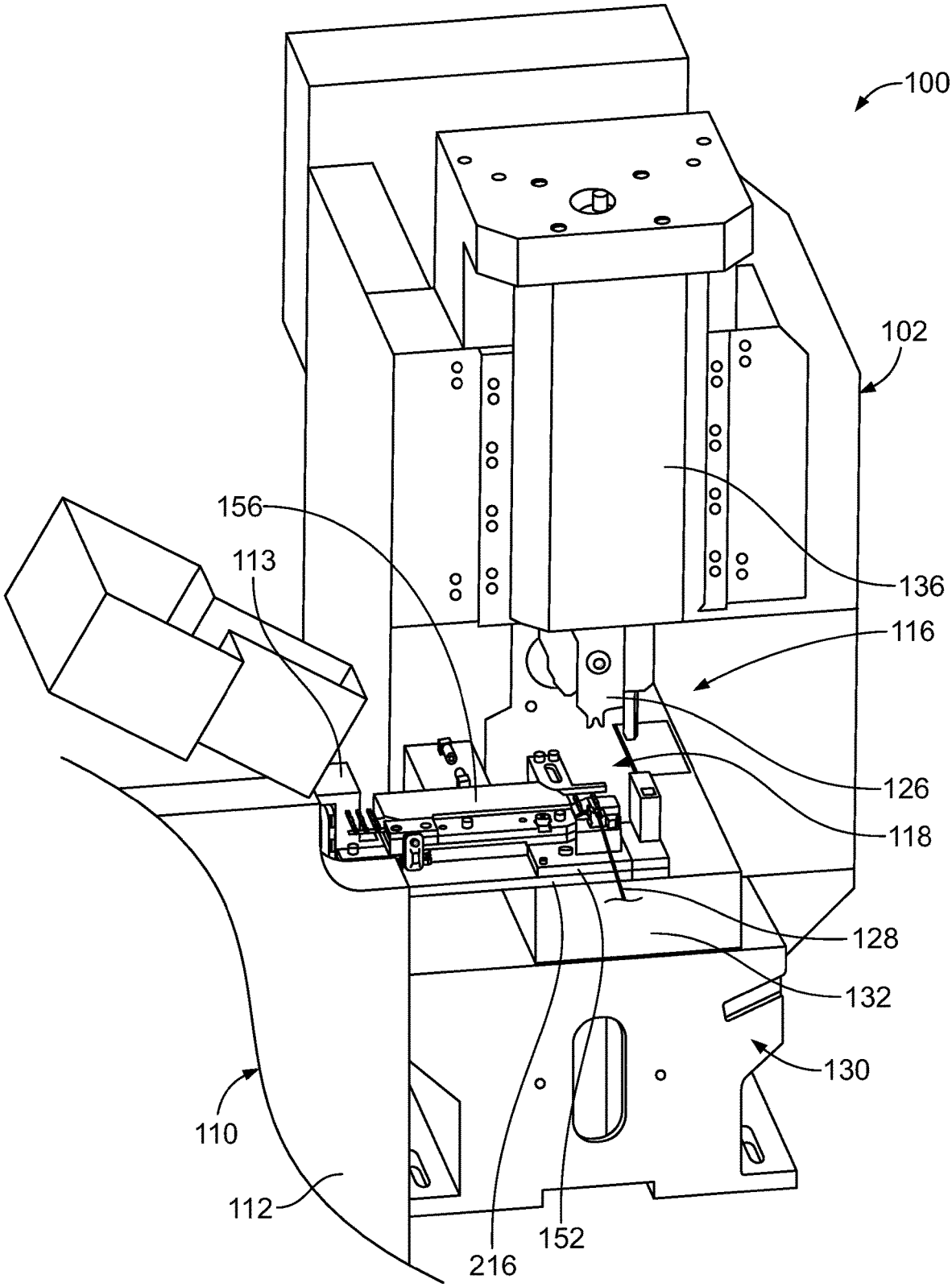
FIG. 11 is a perspective view of a portion of the terminal crimping machine showing the cassette assembly coupled to the termination tool in accordance with an exemplary embodiment.

FIG. 11 is a perspective view of a portion of the terminal crimping machine 100 showing the cassette assembly 110 coupled to the termination tool 102 in accordance with an exemplary embodiment. When the cassette assembly 110 is loaded into the terminal crimping machine 100, the crimp tooling 116 is generally positioned in the crimping zone 118. For example, the cassette assembly 110 presents the lower tooling 128 to the termination tool 102.

The mounting platform 216 supports the lower tooling 128 and is loaded into the termination tool 102. The mounting platform 216 may be secured to the terminator frame 130, such as to the base 132 to position the lower tooling 128 in the crimping zone 118. The base 152 may be fixed to the termination tool 102 while still being fixed to the mounting platform 216. The base 152 of the lower tooling 128 is configured to be removably coupled to and securely fixed by the terminal crimping machine 100. The upper tooling 126 is removed from the lower tooling 128 and coupled to the terminator ram 136 when the cassette assembly 110 is coupled to the terminal crimping machine 100. The lower tooling 128 and the terminal guide 156 do not need to be removed from the housing 112 for set-up, which reduces the overall set-up time of the system. The terminal crimping machine 100 may be operated with the lower tooling 128 and the terminal guide 156 still mounted to the cassette housing 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A terminal cassette assembly for a terminal crimping machine, the terminal cassette assembly comprising:

a cassette housing having a terminal reel chamber and a crimp tooling chamber, the cassette housing enclosing the terminal reel chamber, the terminal reel chamber being configured to removably receive a terminal reel therein having a strip of terminals configured to be crimped to corresponding wires by the terminal crimping machine, the crimp tooling chamber configured to removably receive crimp tooling including lower tooling including an anvil for supporting at least one of the terminal and the wire during crimping and upper tooling including a wire crimper for forming the terminal around the wire during crimping, the cassette housing having a crimp tooling cover covering the crimp tooling chamber, the crimp tooling cover providing access to the crimp tooling, the cassette is configured to be removably coupled to the terminal crimping machine;

wherein the cassette housing is configured to be coupled to the terminal crimping machine such that the terminal reel supplies terminals to the terminal crimping machine; and wherein at least one of the upper tooling and the lower tooling are held in position relative to the terminal crimping machine when the cassette housing is coupled to the terminal crimping machine.

2. The terminal cassette assembly of claim 1, wherein the crimp tooling cover is movable between an open position and a closed position, the crimp tooling being configured to be enclosed by the crimp tooling cover when the crimp tooling cover is in the closed positions.

3. The terminal cassette assembly of claim 1, wherein the crimp tooling is configured to be loaded into the terminal crimping machine with the cassette housing, the lower tooling remaining mounted to the cassette housing when the cassette housing is loaded into the terminal crimping machine.

4. The terminal cassette assembly of claim 1, further comprising a terminal guide received in the crimp tooling chamber, the terminal guide locates the terminal reel relative to the crimp tooling so that the strip of terminals are guided by the terminal guide as the terminals are fed during crimping, the terminal guide remaining coupled to the crimp tooling when the cassette housing is coupled to the terminal crimping machine.

5. The terminal cassette assembly of claim 1, wherein the cassette housing includes a mounting platform, the lower tooling being mounted to the mounting platform when the cassette housing is coupled to the terminal crimping machine.

6. The terminal cassette assembly of claim 1, wherein the cassette housing includes wheels for transporting the cassette housing to the terminal crimping machine.

7. The terminal cassette assembly of claim 1, wherein the cassette housing includes one or more handles for transporting the cassette housing to the terminal crimping machine.

8. The terminal cassette assembly of claim 1, wherein the cassette housing includes a top, a bottom, a front, a rear, a first side and a second side, a terminal reel door being provided at the first side to open and close the terminal reel chamber, the crimp tooling and the crimp tooling cover being provided proximate to the top and the front for loading into the terminal crimping machine.

9. The terminal crimp tooling cassette assembly of claim 1, wherein the cassette housing includes a paper take-up reel winding a paper strip from the strip of terminals.

10. The terminal cassette assembly of claim 1, wherein the cassette housing includes a paper take-up reel winding a paper strip from the strip of terminals, a link being operably coupled between the terminal reel and the paper take-up reel.

11. The terminal cassette assembly of claim 1, wherein the crimp tooling is adjustable relative to the cassette housing to locate the crimp tooling when the cassette housing is coupled to the terminal crimping machine.

12. The terminal cassette assembly of claim 1, wherein the lower tooling includes a base supporting the anvil, the base being coupled to the cassette housing, the base being configured to be removably coupled to and securely fixed by the terminal crimping machine without decoupling the base from the cassette housing.

13. The terminal cassette assembly of claim 1, wherein the cassette housing includes a mounting platform, the crimp tooling being removably coupled to the mounting platform.

14. The terminal cassette assembly of claim 1, wherein the crimp tooling comprises an applicator having an applicator frame supporting the anvil and supporting an applicator ram, the upper tooling being coupled to and movable by the applicator ram, the applicator frame being mounted to the cassette housing, the applicator ram positioned to engage a terminator ram of the terminal crimping machine for driving the applicator ram during crimping.

15. The terminal cassette assembly of claim 1, wherein the upper tooling is removably coupled to the lower tooling and transported by the lower tooling to the terminal crimping machine, the upper tooling being configured to be coupled to a terminator ram of the terminal crimping machine when the cassette housing is coupled to the terminal crimping machine.

16. A terminal cassette assembly for a terminal crimping machine, the terminal cassette assembly comprising:

a cassette housing having a terminal reel chamber configured to hold a terminal reel including a strip of terminals configured to be crimped to corresponding wires by the terminal crimping machine, the cassette housing having a mounting platform, the cassette housing being configured to be removably coupled to the terminal crimping machine;

crimp tooling supported on the mounting platform, the crimp tooling comprising lower tooling including an anvil for supporting at least one of the terminal and the wire during crimping and upper tooling including a wire crimper for forming the terminal around the wire during crimping;

a crimp tooling cover coupled to the cassette housing, the crimp tooling cover enclosing the crimp tooling when closed;

wherein the mounting platform holds at least one of the lower tooling and the upper tooling in position relative to the terminal crimping machine when the cassette housing is coupled to the terminal crimping machine; and wherein the crimp tooling cover is opened to expose the crimp tooling when the cassette housing is coupled to the terminal crimping machine to allow the upper tooling to be operably coupled to the terminal crimping machine during crimping.

17. The terminal cassette assembly of claim 16, wherein the crimp tooling is configured to be loaded into the terminal crimping machine with the cassette housing, the lower tooling remaining mounted to the cassette housing when the cassette housing is loaded into the terminal crimping machine.

18. The terminal cassette assembly of claim 16, wherein the lower tooling includes a base supporting the anvil, the base being coupled to the cassette housing, the base being configured to be removably coupled to and securely fixed by the terminal crimping machine.

19. The terminal cassette assembly of claim 16, wherein the crimp tooling comprises an applicator having an applicator frame supporting the anvil and supporting an applicator ram, the upper tooling being coupled to and movable by the applicator ram, the applicator frame being mounted to the cassette housing, the cassette housing being configured to be coupled to the terminal crimping machine such that the applicator ram is positioned to engage a terminator ram of the terminal crimping machine for driving the applicator ram during crimping.

20. A terminal cassette assembly for a terminal crimping machine, the terminal cassette assembly comprising:

a cassette housing having a terminal reel chamber, the cassette housing enclosing the terminal reel chamber, the terminal reel chamber being configured to removably receive a terminal reel therein having a strip of terminals configured to be crimped to corresponding wires by the terminal crimping machine, the cassette is configured to be removably coupled to the terminal crimping machine;

wherein the cassette housing is configured to be coupled to the terminal crimping machine such that the terminal reel supplies terminals to the terminal crimping machine; and wherein the cassette housing includes a terminal reel door providing access to the terminal reel chamber and wherein the terminal reel door is movable between an open position and a closed position, the terminal reel being configured to be enclosed by the cassette housing when the terminal reel door is in the closed positions.

21. A terminal cassette assembly for a terminal crimping machine, the terminal cassette assembly comprising:

a cassette housing having a terminal reel chamber, the cassette housing enclosing the terminal reel chamber, the terminal reel chamber being configured to removably receive a terminal reel therein having a strip of terminals configured to be crimped to corresponding wires by the terminal crimping machine, the cassette is configured to be removably coupled to the terminal crimping machine;

wherein the cassette housing is configured to be coupled to the terminal crimping machine such that the terminal reel supplies terminals to the terminal crimping machine; and wherein the cassette housing includes a terminal reel support for supporting the terminal reel, the cassette having a driver for rotating the terminal reel support and the terminal reel.

* * * * *